United States Patent [19]

Lindquist

[11] 3,940,089

[45] Feb. 24, 1976

[54] SEWING MACHINE THREAD CONTROL

[75] Inventor: Carl E. Lindquist, Nyack, N.Y.

[73] Assignee: Willcox & Gibbs, Inc., New York, N.Y.

[22] Filed: May 31, 1974

[21] Appl. No.: 475,130

[52] U.S. Cl. ..... 242/156; 112/229; 242/129.8

[51] Int. Cl.[2] ..... B65H 59/04; D05B 57/14

[58] Field of Search ..... 242/156, 156.1, 156.2, 242/129.8, 75.4; 112/229

[56] References Cited

UNITED STATES PATENTS

| | | | |
|---|---|---|---|
| 380,347 | 4/1888 | Phillips | 242/156 X |
| 2,479,710 | 8/1949 | Arnold | 242/156 X |
| 2,517,866 | 8/1950 | Glahn | 242/156 X |
| 3,156,324 | 11/1964 | Colbert | 242/156 X |
| 3,486,473 | 12/1969 | Ross | 112/229 |

*Primary Examiner*—Stanley N. Gilreath
*Attorney, Agent, or Firm*—Flynn and Frishauf

[57] ABSTRACT

To control thread pull-off, particularly in high-speed industrial sewing machines, a rotatable element such as a roller pin is engaged with the bobbin, typically with the outside flange of the bobbin. The pin is rotated, upon spinning of the bobbin, and restrained from free rotation by a spring bearing against the pin. Preferably, the pin is formed with drum or bell-shaped ends, the spring being similar to a bobbin case retaining spring and bearing against a reduced diameter thereof, to provide for different diameters of engaging rotating surfaces between flange and pin, as well as between the flange engaging surface and the spring engaging pin.

14 Claims, 5 Drawing Figures

SEWING MACHINE THREAD CONTROL

The present invention relates to sewing machines, and more particularly to control thread tension in sewing machine bobbins.

The speed of sewing of high-speed sewing machines, particularly of industrial lock-stitch sewing machines, is frequently limited by the acceleration and deceleration rates of the bobbin. If the bobbin is braked too strongly, providing for rapid deceleration when the machine is stopped, the tension of pull-off of the thread, during normal sewing operation and upon acceleration, will be excessive. If, on the other hand, the bobbin runs comparatively freely and the thread is subjected to friction, the bobbin may not stop when sewing is stopped by the operator, thus causing pile-up of the thread inside the bobbin which, upon a subsequent sewing operation, may break. The overspin of the bobbin, that is, continued rotation thereof due to inertia, after the machine itself has stopped, must be controlled in order to provide for proper seams.

Unwinding of the bobbin thread may occur if the tension of the bobbin thread is controlled solely by engagement of the bobbin thread with a resilient element, leaving the bobbin itself unrestrained. If the sewing machine is left idle for some time, the thread may slightly unwind from the bobbin, since the bobbin thread has been wound under tension. Thus, a loose bobbin winding will result. When the machine is started again, and the loose winding of the bobbin thread has been consumed, the thread will have the tendency to break; further, upon starting of the machine, the loose winding of the bobbin thread may become entangled, again causing thread breakage.

Various types of bobbin brakes have been proposed; for example, it has been suggested to include tiny magnets in the bobbin and in the bobbin case, to arrest the bobbin, if no force is applied thereon by thread being pulled off. Such devices, which may also include eddy current brakes, are difficult to introduce in the tiny space available, and additionally do not operate reliably or satisfactorily. Various types of friction brakes have been proposed which, however, either place undue force on the bobbin, and hence strain on the thread which is being pulled off rapidly, upon high speed sewing, or are not effective in stopping the bobbin from overspinning when the sewing machine is stopped. For best stitch formation, the tension of the bobbin should be low, since low bobbin thread tension permits low needle thread tension.

Bobbin thread tension can be controlled in various ways; a customary way is to pass the bobbin thread beneath a spring, that is, to apply friction against the bobbin thread itself. Besides not arresting the bobbin, this has the disadvantage that slubs, knots, and other variations of bobbin thread diameter, as well as variations in the slipperiness of the thread, or its lubrication affect the thread tension, and hence affect the stitch formation.

It is an object of the present invention to provide an arrangement which will provide for improved control of thread tension and control overspin of a sewing machine bobbin, under various operating conditions, so that even short seams can be made at high speed with lockstitch sewing machines.

Subject matter of the present invention: Briefly, a rotatable element, such as a pin, engages the bobbin to be driven thereby, that is, the rotatable element is in rotation transmitting engagement with the bobbin. Preferably, this element is a pin which may be made from the pins customarily used in needle bearings. A yielding spring engages the rotatable element, typically the pin, with the bobbin, preferably by pressing the circumference of the pin yieldingly against the flanges of the bobbin. In a preferred form, the pin is dumbbell-shaped, that is, has a pair of drum or bell-like ends connected by a thinner central shaft, the spring bearing against the thinner central shaft, the dumbbell or drum ends fitting through notches formed in the bobbin case to engage the outer circumference of the flanges of the sewing machine bobbin.

The invention will be described by way of example with reference to the accompanying drawings, wherein.

Figure 1:
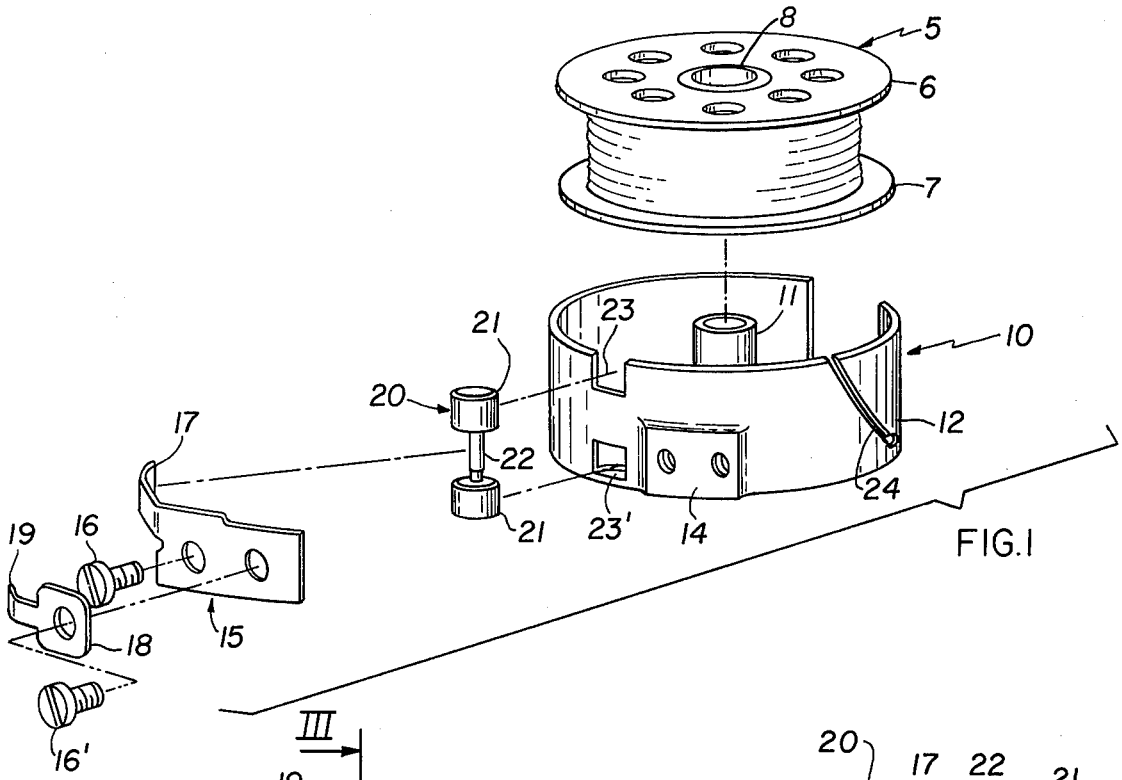
FIG. 1 is a perspective exploded view of a bobbin case with the thread control arrangement, and also illustrating a bobbin with thread thereon.

FIG. 1 clearly shows the five basic elements of the bobbin thread control arrangement: A bobbin 5 having a bobbin body 8 and flanges 6, 7; a bobbin case 10 with a central post 11 about which the bobbin 5 can rotate; a spring 15 secured by means of screws 16, 16' to the bobbin case 10 and applying an adjustable radial force $F_P$ (FIG. 4); and a thread control roller 20 rotatably secured on the bobbin case 10.

The bobbin case 10 has a surrounding shell 12 and a base 13. Shell 12 is formed with a slightly projecting boss 14 and a thread slot 24. The position of the thread slot, and its inclination, if any, with respect to the axis of bobbin case 10 may be suitably selected. The shell 12 of the bobbin case is further formed with two cut-outs 23, 23'. Boss 14 has two tapped holes to receive screws 16, 16' which secure spring 15 to the bobbin case. The spring 15 has a forward bent-in spring lip 17, and two holes for screws 16, 16'. The forwardly projecting spring lip 17 bears against the central portion 22 of roller 20. The end portions 21 of roller 20 are formed bell-shaped or drum-shaped, that is, are cylinders of greater diameter than the central shaft-like portion 22. The cylindrical drum ends 21 of the roller 20 fit through the notches or cut-outs 23, 23' of the bobbin case shell 12, to engage the flanges 6, 7 of the bobbin 5, when the bobbin is assembled in the bobbin case. The lip 17 can be tightened against the shaft 22 of the roller 20 by tightening the screw 16.

Figure 3:
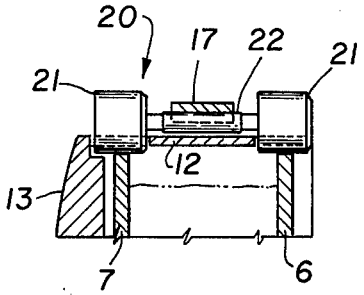
FIG. 3 is a sectional view along lines III—III of FIG. 2, and with a bobbin in the case, illustrating the roller in side view.

With a bobbin removed, the roller 20 fits into the notches or cut-outs 23, 23' and spring 15 presses its shaft-like portion 22 against case 10. It is retained in axial position by the opening 23', and restrained from falling out of the notches by the spring lip 17. When a bobbin 5 is inserted in case 10, the flanges 6, 7 thereof lift roller 20 away from engagement with the wall 12 of case 10 (see FIG. 3).

The spring 15 mounted like a standard bobbin case spring applies adjustable, radial pressure to the roller 20 which, in turn, applies lateral, radial pressure to the bobbin flanges 6, 7. This pressure does not, however, apply drag only but rather permits rotation. The diameter of the drum ends 21 of roller 20 is, of course, much less than the diameter of the flanges 6, 7 of bobbin 5, so that the roller 20 will spin at a much higher rate than the speed of rotation of bobbin 5. As an example, typical diameters are: about 2 cm for the flanges 6, 7 and about 3 mm for the drum ends 21 of roller 20. Preferably, the engaging ends of the roller 20 should have a diameter not more than 25% of that of the bobbin flanges 6, 7. The roller 20 replaces the standard thread tension spring on a standard bobbin; bobbin thread tension is applied by the spring lip 17, adjustable by tightening screw 16. The tension is adjusted to provide for proper operating tension of the lower or bobbin thread.

The setting of tension screw 16 is maintained, or locked, as adjusted, in spite of operating vibration by a loading spring 18, secured over spring 15 by screw 16' and bearing with lip 19 over screw 16. Alternatives to spring 18 may be used, such as plastic coating the threads of the screw 16.

The structure of the present invention results in improved stitch formation; the bobbin thread tension can be reduced, and will be more uniform. Reducing the bobbin thread tension, in turn, permits reduction of needle thread tension. The tension on the bobbin thread is less sensitive to the amount of thread on the bobbin, and unspooling of the bobbin, upon shut-down of the machine due to bobbin thread tension, is effectively eliminated.

Figure 4:
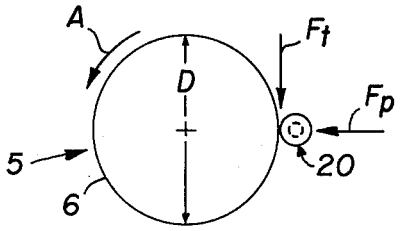
FIG. 4 is a schematic diagram illustrating force relationships arising during operation of a sewing machine utilizing the present invention.

By exerting uniform pressure against the bobbin flanges by the roller, and the rolling action of the roller against the flanges permits lesser bobbin thread tension, and results in more uniform tension as the bobbin thread is drawn off. Referring to FIG. 4, where arrow A illustrates the direction of rotation of a bobbin 5: the tangential force $F_T$, opposing rotation, is shown as well as the radial force $F_P$ of pressure exerted by the spring 15. This force is adjustable. The tangential force $F_T$ is constant for any given speed of the bobbin, and for any given pressure $F_P$ with which the roller 20 is pressed against the bobbin 5. This force is independent of thread diameter; thread surface, including slubs, knots, and the like, thread surface finish, and lubrication thereof; the amount of thread on the bobbin, and the composition of thread, that is, for example all cotton, cotton blend, spun synthetic, or monofilamentary synthetic material of various types.

Reduced, and more uniform bobbin thread tension permits reducing needle thread tension. Due to the reduction in bobbin thread tension, the tension in the needle thread to form a stitch is decreased. Since any individual point on the needle thread passes about 40–65 times through the needle eye before being actually consumed in a stitch, the abrasion on the thread is reduced if less tension on the needle thread itself is required. This decreased abrasion, and decreased tension is reflected in actual sewing operations in fewer breaks of the needle thread. Reduced tension at the needle thread also reduces heat generated by the thread passing through the needle eye, thus further decreasing breakage.

Referring again to FIG. 4: Since the tension on the bobbin is created by the force $F_T$, which is at a uniform distance from the center of the bobbin, the amount of thread on the bobbin has hardly any effect on the total bobbin thread tension, as it appears at the point where the stitch is actually formed. Even though the bobbin may be wound under tension, the force on the bobbin will not permit the bobbin thread to unwind, eliminating a loose winding even upon prolonged shut-down of the machine.

In operation, the bobbin will stop if pull-off tension on the bobbin thread stops, with no overrun, or overspin, regardless of the quantity of thread wound on the bobbin.

Pull-off of the bobbin thread is more uniform than heretofore. The pull-off tension can be reduced, thus permitting lower needle thread tension, contributing to overall improved sewing performance.

The bobbins 5 preferably should have accurately prepared flanges; if the flanges are bent, or have nicks and burrs, the roller 20 can get stuck, and thus the drag applied by the roller on the bobbin 5 would become uncontrollable, and frequently excessive. Bobbins with steel flanges are preferred; aluminum, paper, and plastic bobbins are also suitable, however. The roller 20 itself, can be easily made by longitudinally cutting a needle bearing pin to proper axial length, and then grinding the shaft 22 sufficiently to provide for projecting drum ends 21 which can fit in the notches 23 and project internally sufficiently to engage the flanges 6, 7 of a standard bobbin.

Figure 2:
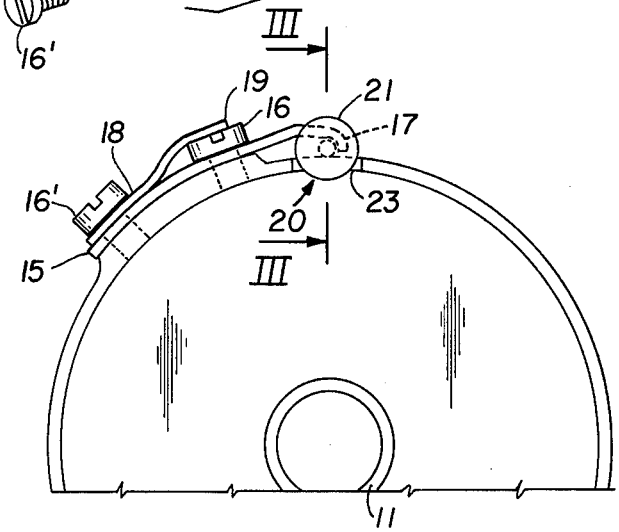
FIG. 2 is a schematic fragmentary top view of the bobbin case, with the thread control device thereon.
Figure 5:
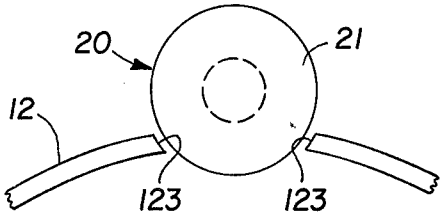
FIG. 5 is a fragmentary top view of another embodiment of a cut-out edge of a bobbin case.

The spring 15 may have various shapes, and need not be a sheet spring, as shown, but may be a wire spring, bent in a suitable shape, for adjustably retaining the spring on the outside of the bobbin case. The bobbin roller, preferably, is hardened or otherwise surface-treated and polished to provide for long operating life. The edges of the cut-outs 23, 23' may be radial (FIGS. 1, 2) or, as seen at 123 in FIG. 5, may be matched to the curvature of roller drums 21. The width of the slots 23, 23' is just slightly less than the diameter of the roller, e.g. about 10% less. The clearance between the roller drums 21 and the slots 23, 23' is controlled to prevent skewing of the roller 20, e.g. due to variations in diameter of the flanges 6, 7 of bobbin 5, or uneven winding of the bobbin. The form of the edge 123 (FIG. 5) provides better restraint against skewing but is more costly to manufacture. The bent lip 17 at the end of spring 15, i.e. the shape of the spring partly surrounding shaft 22 also prevents skewing of roller 20.

I claim:

1. In a sewing machine bobbin case (10) having means (11) to rotatably support a bobbin (5) with flanges (6, 7) thereon, means to control bobbin rotation and bobbin thread tension comprising a roller (20) having its terminal end portions (21) in engagement with the edges of the flanges (6, 7) of the bobbin (1), said roller having a diameter at the engagement surface which is small with respect to the diameter of the bobbin flanges;

and yielding means (15, 17) yieldingly engaging the roller (20) and retaining the roller in position on the case and in yielding, frictional, rotational, engagement with the flanges (6, 7) of the bobbin, the yielding means applying a yielding drag on the roller which is transferred to the bobbin by engagement between the roller and the flanges of the bobbin.

2. Sewing machine bobbin case according to claim 1, wherein the yielding means comprises an elongated spring (15) secured to the outside of the case (10) and having a terminal lip (17) overlapping and engaging the roller (20).

3. Sewing machine bobbin case according to claim 1, wherein the yielding means comprises a spring (15) secured to the outside of the case (10) and having a terminal lip (17) overlapping the roller (20) in the region (22) between the end portions (21) in engagement with the flanges (6, 7) of the bobbin (5).

4. Tension control means according to claim 3, wherein the roller end portions (21) are bell or drum-shaped, and the region between the end portions is a shaft (22) of a diameter less than the diameter of the drum or bell end portions (21), the terminal lip (17) of the spring (15) engaging the shaft of the roller (20).

5. Sewing machine bobbin case according to claim 1, wherein the roller end portions (21) are bell or drum-shaped, and the region between the end portions is a shaft (22) of a diameter less than the diameter of the drum or bell end portions (21).

6. Tension control means according to claim 5, wherein the bobbin case (10) is formed with cut-outs (23, 23′) slightly less wide than the bell or drum end portions (21) of the roller (20), said bell or drum end portions (21) fitting into the cut-outs;

the yielding means comprises a spring (15) secured to the case (10) and having a terminal lip; and the roller shaft (22) is located adjacent the case (21) and is retained on the case by engagement of the terminal lip (17) of the spring (15) overlapping the shaft (22) of the roller, to permit engagement of the flanges (6, 7) of a bobbin (5) in the case (10) with the drum end portions (21) of the roller extending through the cut-outs (23, 23′).

7. Sewing machine bobbin case according to claim 6, wherein the spring (15) is adjustably secured to the case (10) to permit adjustment of tension of the spring (15) on the roller (20).

8. Sewing machine bobbin case according to claim 7, further comprising means (18) locking the adjusted spring tension setting.

9. Sewing machine bobbin case according to claim 8, wherein spring (15) is secured to the case by an adjustment screw (16) and the locking means comprises a loading spring (18) bearing against the head of said adjustment screw (16).

10. In a sewing machine bobbin case (10) having means to rotatably retain a bobbin (5) having flanges (6, 7) in the case (10), means to control bobbin rotation and bobbin thread tension comprising a roller engaging the flanges (6, 7) of the bobbin (5) at a diametrical engagement point remote from the axis of rotation of the bobbin to be in rotation-transmitting engagement therewith, said roller having a radius of rotation which is small with respect to the distance of the engagement point of the roller on the flanges of the bobbin from the axis of rotation of the bobbin;

and a spring means (15) engaging the roller and retaining said roller in said rotation-transmitting engagement with the bobbin (5) the spring means applying a yielding drag on the roller which is transferred to the bobbin by engagement between the flanges of the roller and the bobbin.

11. Bobbin case according to claim 10, wherein the spring means (15) engaging the roller (20) are adjustably, resiliently pressed thereagainst.

12. Bobbin case according to claim 11, wherein the case (10) is formed with openings (23, 23′) therein located in alignment with the edges of the flanges (6, 7) of the bobbin (5);

and the roller (20) extends into the opening (23, 23′) to engage said flanges.

13. Bobbin case according to claim 12, wherein the roller is a dumbbell-shaped roller (20) having a pair of drum-shaped end portions (21) and a connecting shaft portion (22) of lesser diameter between the end portions; and the spring (15) is secured to the outside of the case (10) and has a terminal lip (17) which overlaps and partly surrounds the shaft portion (22) of the roller (20).

14. Bobbin case according to claim 1, wherein the roller (20) is a dumbbell-shaped roller having a pair of drum-shaped end portions (21) and a connecting shaft portion (22) of lesser diameter between the end portions;

and the spring (15) is secured to the case (10) and has a terminal lip (17) which overlaps and partly surrounds the shaft portion (22) of the roller (20).

* * * * *